United States Patent [19]

Messick et al.

[11] 4,164,831

[45] Aug. 21, 1979

[54] HEAT INSULATING AND SOUND ABSORBING CONCRETE WALL PANEL

[76] Inventors: William E. Messick, 1445 S. Bascom Ave. #53, San Jose, Calif. 95128; Bernard L. Gabrielsen, 5858 Pilar Ct., San Jose, Calif. 95120

[21] Appl. No.: 835,318

[22] Filed: Sep. 21, 1977

[51] Int. Cl.[2] ..... E04B 2/00

[52] U.S. Cl. ..... 52/405; 52/601; 52/612; 52/583; 52/587

[58] Field of Search ..... 52/404–410, 52/601, 602, 378–383, 583, 587, 309.4, 309.6, 309.9, 309.10, 309.11, 309.12, 612

[56] References Cited

U.S. PATENT DOCUMENTS

| | | | |
|---|---|---|---|
| 646,178 | 3/1900 | Hubert | 52/602 |
| 2,047,109 | 7/1936 | Nagel | 52/405 |
| 2,114,048 | 4/1928 | Davis | 52/602 |
| 2,592,634 | 4/1952 | Wilson | 52/410 |
| 2,964,821 | 12/1960 | Meehan | 52/378 |
| 3,495,367 | 2/1970 | Kobayashi | 52/587 |
| 3,943,676 | 3/1976 | Ickes | 52/309.11 |

FOREIGN PATENT DOCUMENTS

| | | | |
|---|---|---|---|
| 203688 | 5/1959 | Austria | 52/404 |
| 994803 | 11/1951 | France | 52/405 |
| 23333 | 1/1901 | Switzerland | 52/381 |

*Primary Examiner*—James L. Ridgill, Jr.
*Attorney, Agent, or Firm*—John J. Leavitt

[57] ABSTRACT

Presented is a concrete wall panel that provides both thermal insulation and sound absorption while possessing the necessary rigidity and strength to permit the panel to be manufactured at a site remote from the point of installation, transported to the point of installation and then hoisted into position by appropriate hoisting equipment.

6 Claims, 19 Drawing Figures

FIG. 4.
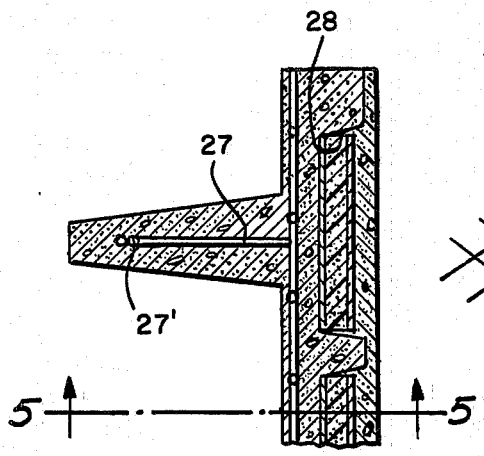
FIG. 6.
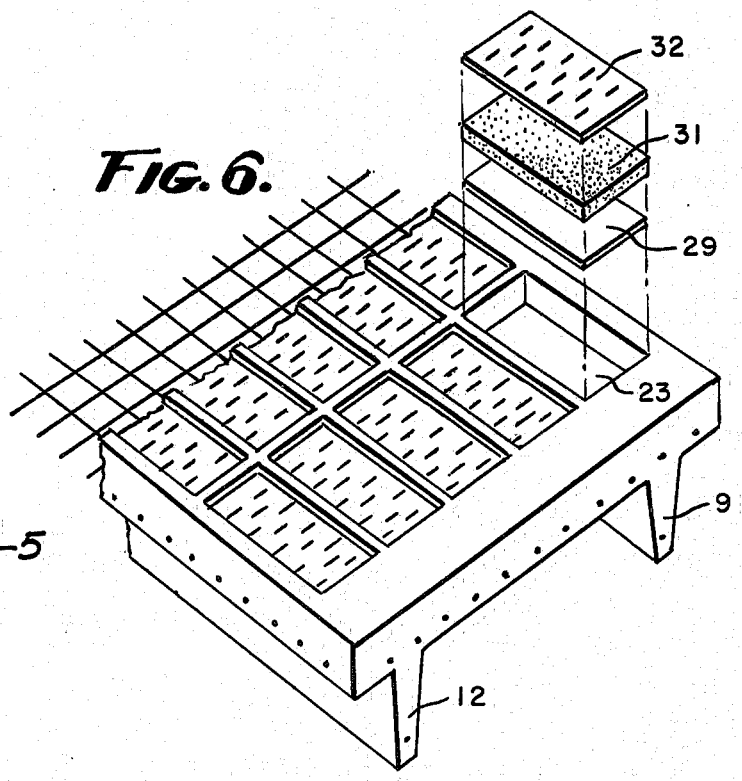
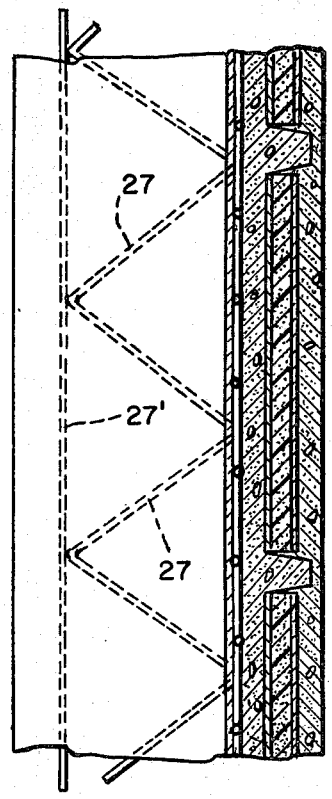
FIG. 5.
FIG. 7.
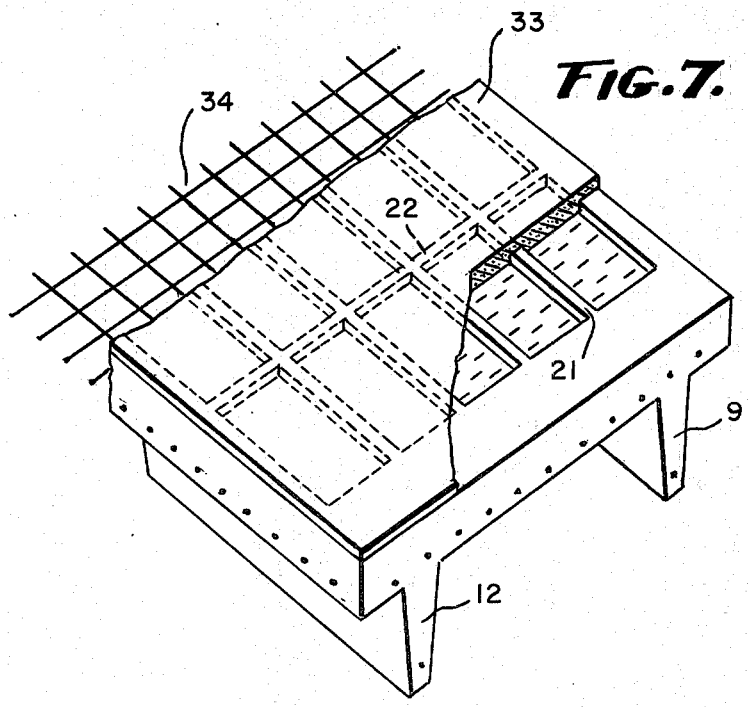

FIG. 12.
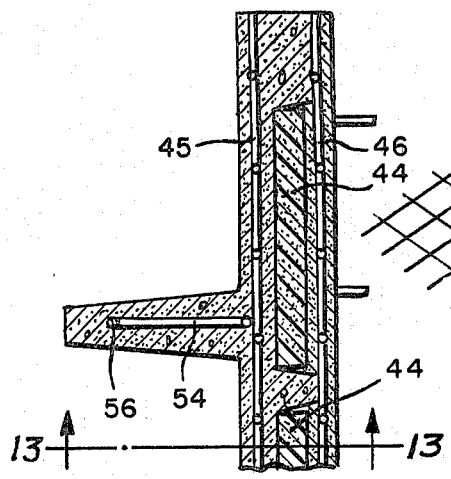
FIG. 14.
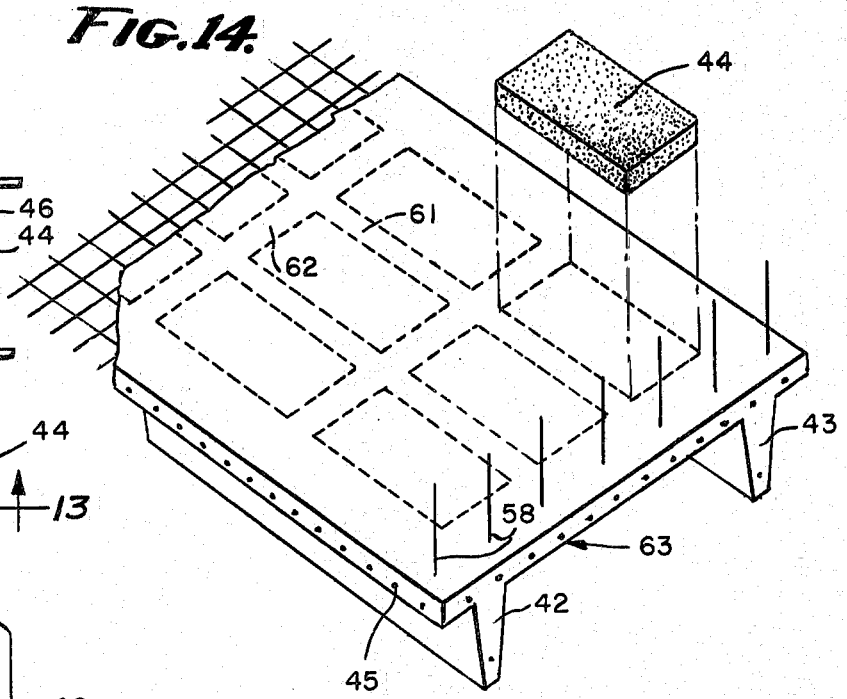
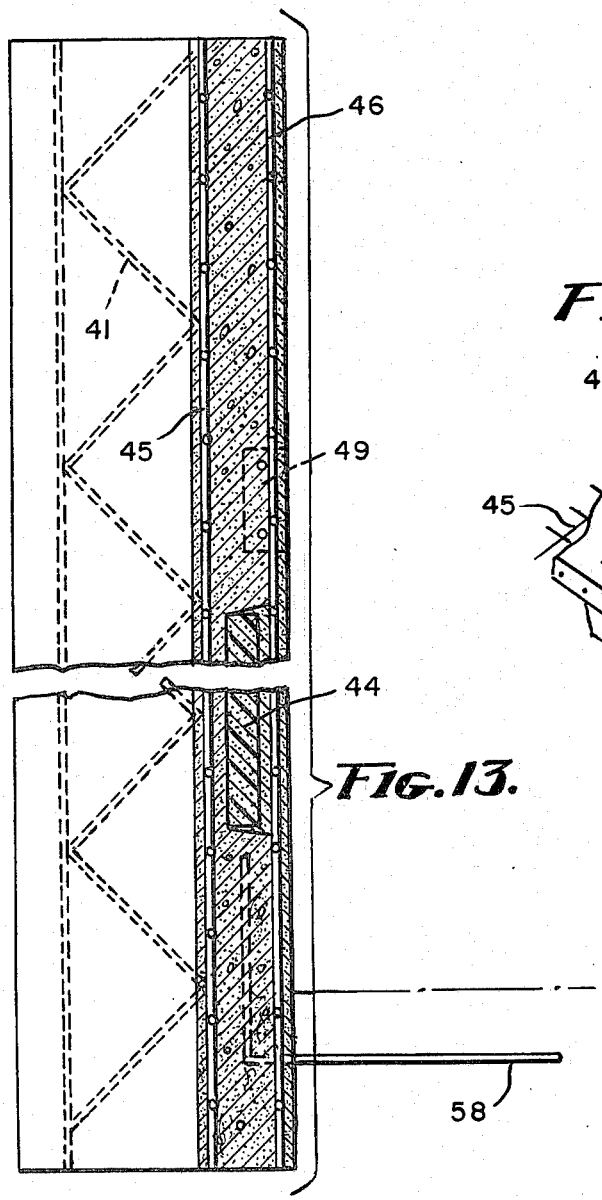
FIG. 13.
FIG. 15.
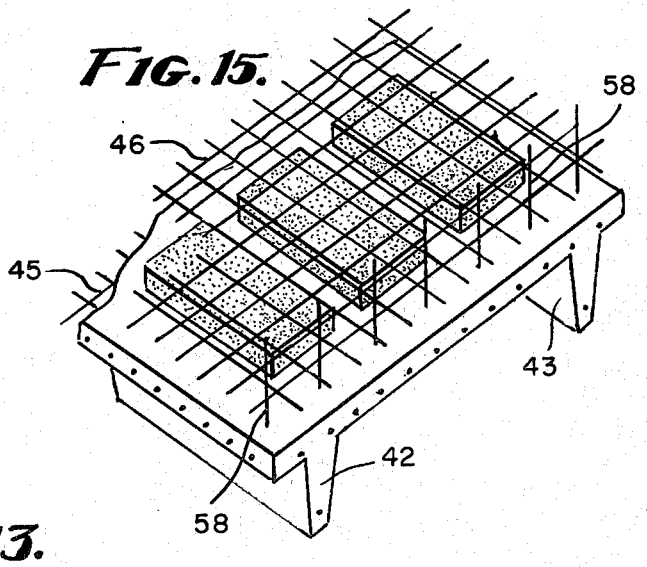
FIG. 16.
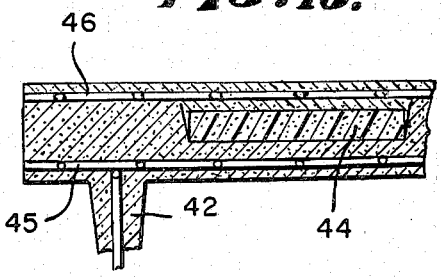

HEAT INSULATING AND SOUND ABSORBING CONCRETE WALL PANEL

BACKGROUND OF THE INVENTION

This invention relates to concrete panels, and particularly to such panels as may be used for constructing the walls of concrete buildings, especially the exterior walls of such buildings, where it is desirable that thermal insulation be provided by such exterior walls so that a loss of heat from the interior of the building to the exterior thereof is minimized. In another aspect of the invention, the concrete wall panels are constructed to provide sound absorption so as to insulate the interior of the building from bothersome and even destructive noises outside a building, or which may be used in a fence line for instance such as the type that surround housing developments to shield such developments from the noise pollution created by adjacent street and highway traffic. Accordingly, it is one of the objects of the present invention to provide a precast concrete panel that may be manufactured at a point remote from the point of installation and then transported to such point of installation and be hoisted into its final position.

The construction of concrete buildings through the expedient of precasting concrete panels which are then transported to the building site and hoisted into position, even for multistory buildings, is a relatively recent innovation. Heretofore, concrete buildings have been cast in place by pouring concrete into forms constructed to contain the concrete until it sets, after which, the forms are removed. With the increse in labor and material costs, such construction methods have become prohibitive in cost and other innovations have had to be developed to reduce costs. Such innovations in most instances involve the pre-casting of concrete panels and the subsequent transportation of such panels and the hoisting thereof into ultimate position.

With the increased emphasis on the necessity to conserve energy, another problem that has arisen is the escape of heat from the interior of a building to the exterior thereof, thus constituting a waste. Accordingly, another innovation that has occurred is the insulation of concrete panels to minimize or prevent the passage of thermal energy therethrough. Accordingly, another object of the present invention is to provide a concrete building panel incorporating such thermal insulating means.

In addition to the conservation of heat energy, it has been found that productivity of personnel working within a concrete building can be increased if noise level within the building or within the immediate area is maintained within certain limits. Accordingly, another object of the present invention is to provide a pre-cast concrete panel incorporating sound absorbing means therein.

As indicated above, one of the motivating factors for innovations of this type in the construction industry has been the tremendous increase in the cost of labor and materials. Thus, another object of the invention is the provision of a concrete building panel designed in a way to save time in its manufacture and which may be assembled with other such panels in an efficient way to save the cost of field labor and energy.

In most instances, poured in place concrete buildings are considerably heavier than buildings fabricated from pre-cast panels. Such poured in place concrete buildings require much heavier and therefore most costly footings to support the weight of the building, and as indicated above, utilize building procedures that are inherently more costly. Accordingly, still another object of the invention is the provision of a light weight pre-cast concrete building panel which weighs much less than a conventional concrete panel, thus resulting in a significant saving of materials, but also substantially reducing vertical design loads and lateral earthquake induced loads.

As indicated above, one of the problems sought to be solved by the pre-cast concrete panel of this invention is the saving of thermal energy. Accordingly, one of the objects of the present invention is the provision of a pre-cast concrete panel in which the heat loss through the panel can be a sixth to a fiftieth of that through conventional concrete panels of equal thickness.

SUMMARY OF THE INVENTION

In terms of broad inclusion, the pre-cast concrete panel system of the invention comprises two suitably designed thin layers of fine aggregate concrete each reinforced by welded wire fabric and bars, reinforcing bars, or a reinforcing matt, or combinations thereof, between which is sandwiched a similarly thin layer of a synthetic resinous foam material. Means are provided tying the two facing sheets of fine aggregate concrete together to provide flexural rigidity as well as resistance to buckling in compression and shear.

BRIEF DESCRIPTION OF THE DRAWINGS

FIG. 4 is a fragmentary cross-sectional view in enlarged scale taken in the plane indicated by the line 4—4 in FIG. 1.

FIG. 5 is a fragmentary sectional view taken in the plane indicated by the line 5—5 in FIG. 4.

FIG. 6 is a fragmentary perspective view of the embodiment illustrated in FIG. 1 showing a portion of the sound and thermal absorbing means exploded from the remaining structure.

FIG. 7 is a fragmentary perspective view showing the panel of FIG. 1 with a facing sheet applied thereto and a portion of the facing sheet broken away to reveal the sound and heat insulating means sandwiched in position in the panel between two facing sheets.

FIG. 12 is an enlarged fragmentary sectional view of one portion of the panel of FIG. 8, illustrating the internal construction.

FIG. 13 is an enlarged cross-sectional view taken in the plane indicated by the line 13—13 in FIG. 12.

FIG. 14 is a fragmentary perspective view showing the thermal insulating panel in one stage of its construction.

FIG. 15 is a fragmentary perspective view showing the panel in another stage of its construction.

FIG. 16 is an enlarged fragmentary end view of the completed panel.

DESCRIPTION OF THE PREFERRED EMBODIMENT

In terms of greater detail, it is one of the purposes of the present invention to provide a concrete building panel of relatively large size, for example, up to fifty feet long and having varying widths to accomodate specific building designs, each of the panels being fabricated so that within its interior there lies embedded one or more bodies of insulating material that replaces a large proportion of the concrete found in conventional single-material concrete panels. It will of course be obvious that combining concrete with insulating material in the manner suggested herein greatly reduces panel weight and greatly increases panel thermal insulation capabilities without significant sacrifice of panel strength. In addition, a considerable increase in high frequency noise attenuation is achieved. For instance, the measured thermal conductivity of a test panel with a two inch foam core sandwiched between one-half inch thick mortar facings was found to be 0.1 BTU/Hr./ft./F° compared with 4.22 BTU/Hr./ft./F° for a three inch thick concrete section, this ratio translating to a 42 to 1 improvement.

Figure 1:
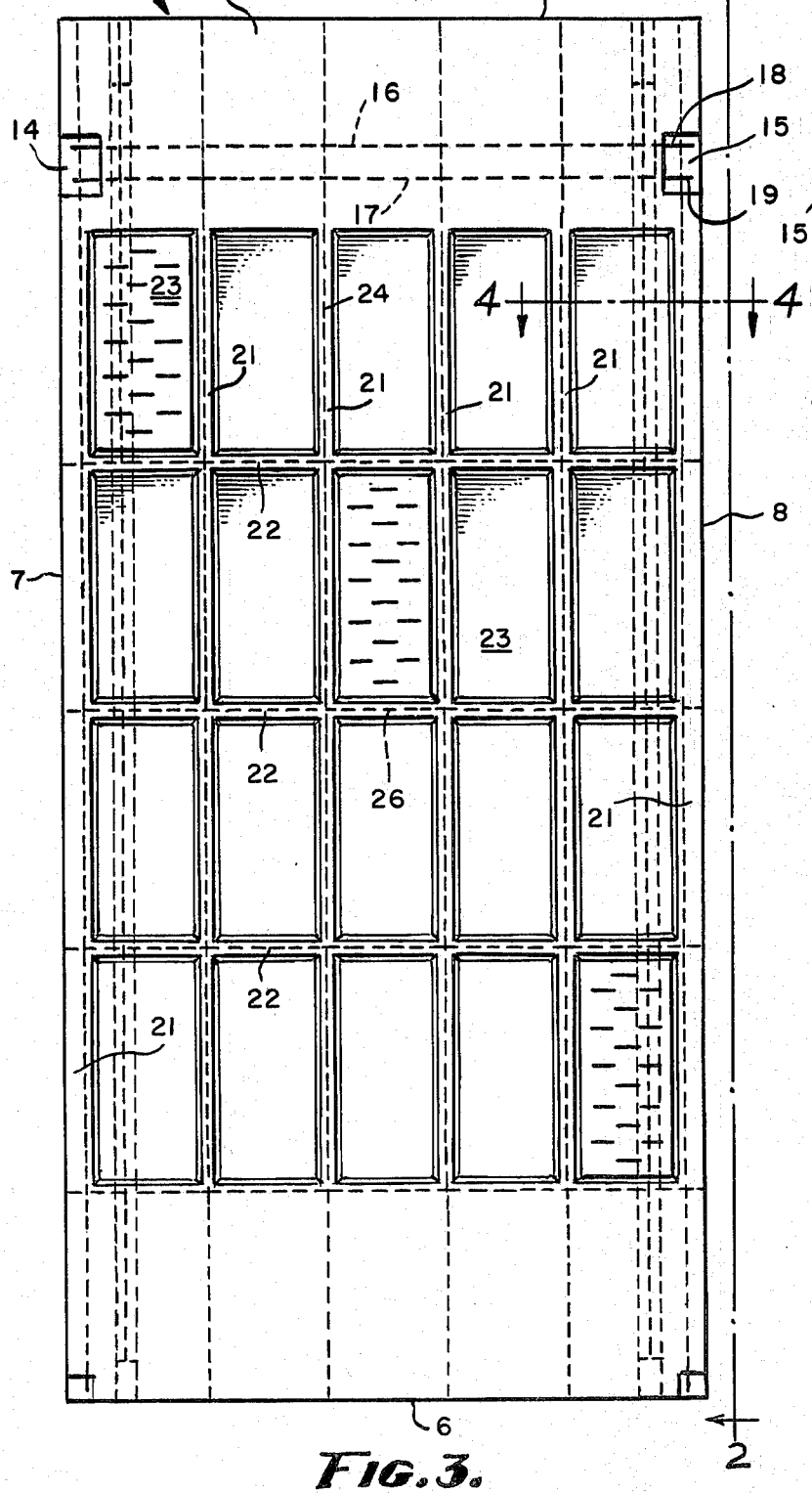
FIG. 1 is a plan view of one embodiment of the invention.
Figure 2:
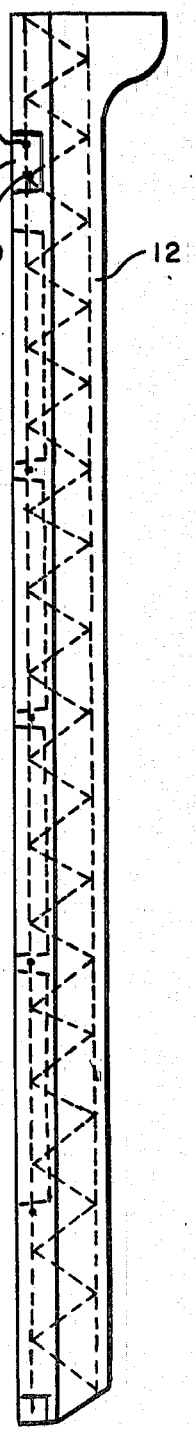
FIG. 2 is an edge elevational view of the panel illustrated in FIG. 1.
Figure 3:
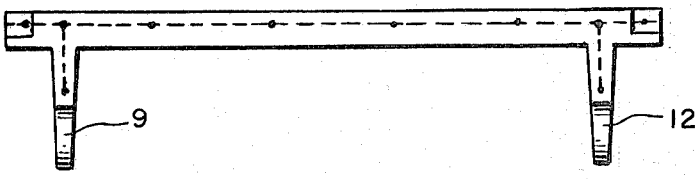
FIG. 3 is an end elevation of the panel illustrated in FIG. 1.

Referring to FIG. 1, there is there illustrated a panel designed to provide both sound and thermal insulation, the panel being designated generally by the numeral 2, and having a main body portion 3, a top edge 4, a bottom edge 6, and left and right edges 7 and 8, respectively. Formed adjacent the longitudinal edges 7 and 8 are ribs 9 and 12, respectively, the ribs providing the necessary strength to withstand vertically imposed roof loads on the panel which are transmitted by the panel to the ground, thus eliminating any need for separately formed columns between panels as is customary in conventional tilt-up concrete construction. Additionally, it has been found that with this design, because of high rigidity, strength and light weight, panels may be constructed two or more stories in height.

Each of the panels is preferably fabricated from concrete that is poured into an appropriate form or mold to provide the rectangular exterior configuration illustrated, the panel being strengthened by the addition for example, of welded wire fabric 13, conveniently formed to provide 6×6 inch apertures defined by No. 6 wire. Adjacent the top edge 4 of the panel, and positioned along the longitudinal edges 7 and 8, there are provided recessses 14 and 15, the panel also being provided at this location with transversely extending reinforcing ties 16 and 17 that terminate in the recesses 14 and 15 in exposed ends 18 and 19 utilized to tie adjacent panels together.

Additional strength and rigidity is provided by forming the panel with a series of recesses defined by longitudinally extending studs 21, the panel illustrated being provided with six such longitudinally extending studs, which are formed integral with transversely extending rail members 22 which cooperate with the studs 21 to define rectangular recesses 23 for purposes which will hereinafter be explained.

To add still additional rigidity and flexural strength to the panel, there is embedded in the concrete at the location of each of the longitudinal studs 21 appropriately sized reinforcing bars 24, while there is likewise embedded in the transversely extending integral rails 22, reinforcing bars 26. For still additional strength, the ribs 9 and 12 are provided with truss-form reinforcing bars 27 as shown best in FIG. 5, which may hereinafter be referred to as ladder-form bars, the outer extremities of the ladder bars being welded to a through-bar 27′ as shown.

In the panel illustrated in FIGS. 1–7, an end portion of the panel adjacent each of the end edges 4 and 6 is devoid of recesses such as recesses 23. The rest of the panel however, is provided with the recesses so that a major surface area of the panel is incorporated by the recesses 23, each of which, as illustrated in FIG. 4, is provided with side edges 28 having a slight taper as illustrated, the degree of taper being in the order of about 7° or less, yet sufficient to permit withdrawal of the forms that shape the recesses, and adequate to provide a wedging action with multiple layers of thermal insulation 29 (FIG. 6), sound absorbing material 31 and a cover plate 32 of expanded metal wedged into the recess on top of the thermal insulation and sound absorbing material so that the edges of the expanded metal plate 32 wedgingly engage the inclined sides 28 of the recess to thereby retain the thermal insulating and sound absorption layers within the recess.

In the embodiment of the invention illustrated in FIG. 7, there is shown a variation of the construction illustrated in FIG. 1–6. The construction illustrated in FIG. 7 includes everything disclosed in FIG. 1–6, but adds a facing sheet 33 a poured concrete reinforced by an appropriate wire mesh 34 and serving to enclose both the sound absorption and thermal insulation within the body of the panel. In this way, while sound absorption and thermal insulation are provided in the panel, the panel is provided with two relatively flat and smooth faces apart from the reinforcing ribs 9 and 12. It will thus be seen that in both the embodiment illustrated in FIG. 7, the panels provide the facility of defining rectangular areas which upon installation may be opened up to provide an opening for a window or door through the panel as may be desired by a given customer. All that is required in that instance is that the facing sheets be cut with appropriate concrete cutting equipment so as to expose the "studs" that might lie within the perimiter of the desired opening, with subsequent removal of that portion of any stud that passes through the opening. It has been found in both the embodiments illustrated in FIGS. 1 and 7 that facing sheets having a thickness of one inch and ribs 9 and 12 having a depth of 12 inches and a thickness of 3 inches at the root provides sufficient strength and rigidity to withstand all normal roof loads, loads imposed by earthquakes, and wind loading applied normal to the surface of the panel.

Figure 8:
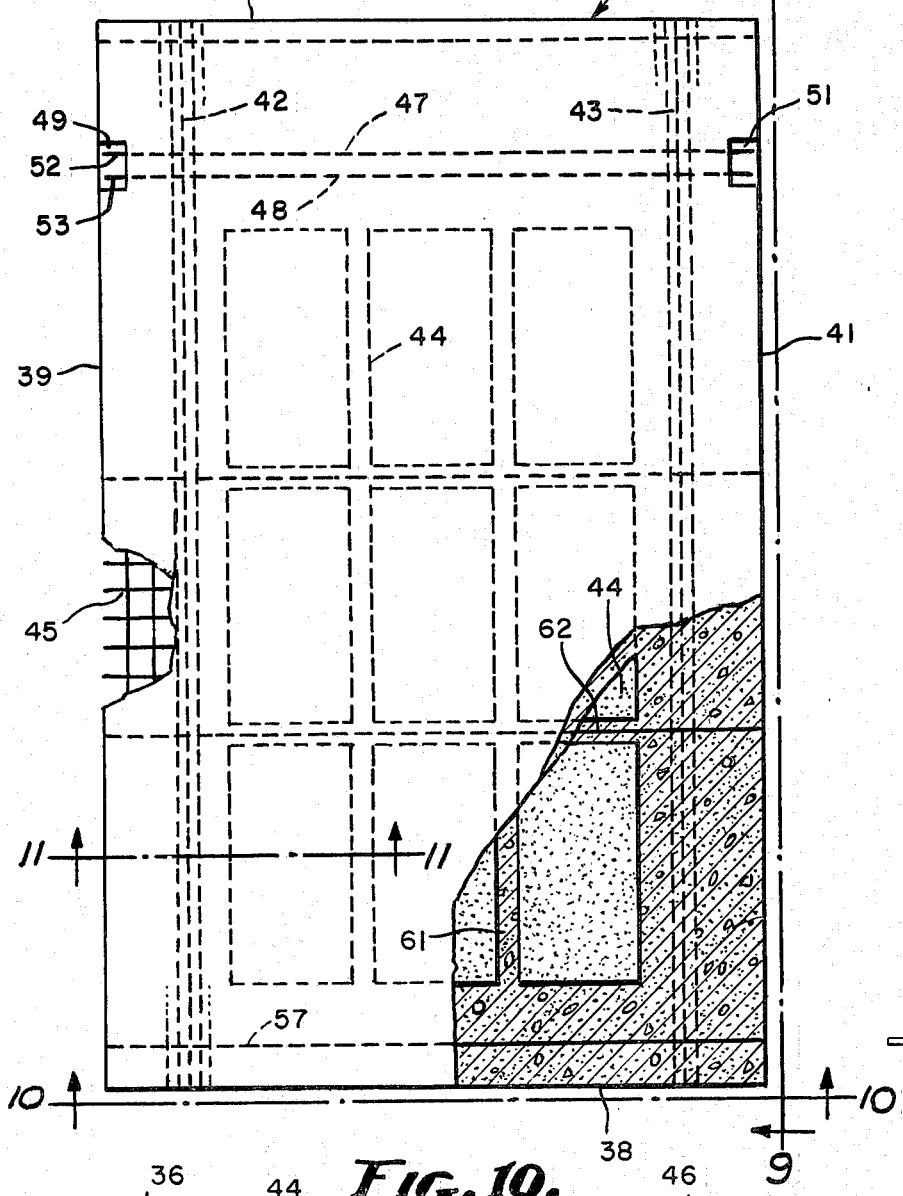
FIG. 8 is a plan view of another embodiment of the invention a portion of the facing sheet being broken away to disclose the underlying structure.

In the embodiment of the invention illustrated in FIGS. 8 through 16, there is illustrated a panel that is designed specifically to provide thermal insulation. As there illustrated, the panel is designated generally by the numeral 36, the panel being formed in a generally rectangular configuration having top and bottom edges 37 and 38, and longitudinally extending lateral edges 39 and 41. As with the panel illustrated in FIGS. 1 through 7, reinforcing ribs or flanges 42 and 43 extend from one face of the panel for a depth of approximately one foot and are formed integral with the associated face of the panel, which is preferably approximately one inch thick. As before, the panel in question is formed by pouring plastic concrete into an appropriate form or mold to the required depth to provide the one inch thick "skin". Thereafter, blocks or plates 44 of an appropriate thermal insulative material such as rigid polystyrene foam, are distributed over a designated area of the panel as illustrated in FIG. 8. It should be understood that when the initial face of the panel is poured, it is poured in and around an appropriate layer 45 of welded wire mesh that remains embedded in the facing sheet of concrete.

After placement of nine blocks or slabs of polystyrene thermal insulative foam material as illustrated in FIG. 8, another layer of expanded wire mesh 46 is superimposed over the insulating slabs and additional plastic concrete is thereafter poured over the entire assembly so as to suitably embed the slabs of polystyrene foam insulative material and the wire mesh 46 and thereby form the facing sheet of the opposite side of the concrete panel.

Figure 9:
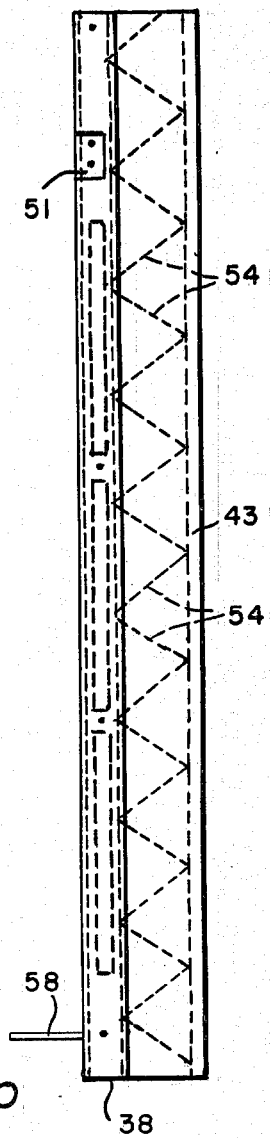
FIG. 9 is an edge elevational view of the panel shown in FIG. 8 taken in the direction indicated by the arrows 9—9 in FIG. 8.
Figure 10:
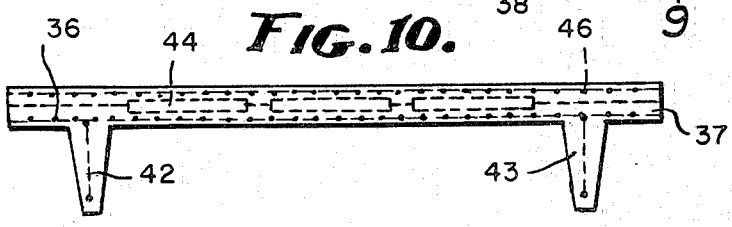
FIG. 10 is a bottom edge view taken in the direction of the arrows 10—10 in FIG. 8.
Figure 11:
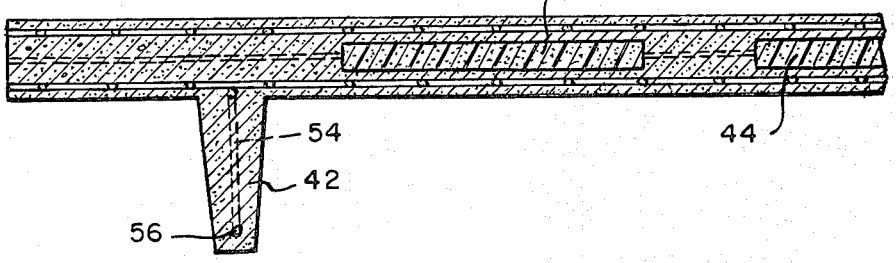
FIG. 11 is a fragmentary cross-sectional view shown in enlarged scale and taken in the plane indicated by the line 11—11 in FIG. 8.

To lend additional rigidity to the panel, tie rods or tie wires 47 and 48 extend transversely of the panel adjacent the end 37, terminating at opposite ends in recesses 49 and 51, the terminal ends 52 and 53 being appropriately used to tie two adjacent panels together. As indicated in FIGS. 9 and 11, each of the ribs 42 and 43 is provided with a reinforcing ladder structure 54 to lend strength to each rib, each of the ladder structures 54 being fabricated from an appropriate reinforcing bar bent in a zig-zag pattern as indicated, with the outermost extremities of the ladder being joined by a longitudinally extending rod 56.

As illustrated in FIG. 8, the lowermost end of the panel is provided with a transversely extending reinforcing bar 57 appropriately secured to the associated wire mesh, and having adjacent each opposite edge of the panel a projecting portion 58 that is utilized to tie the base of each panel to the associated floor by having the projecting portion 58 embedded within the concrete floor after it is poured. It will thus be seen that a multiplicity of such panels may be associated edge-to-edge and the terminal ends 52 and 53 of the tie rods 47 and 48 interengaged by appropriate coupling means (not shown) so as to rigidly tie two adjacent panels together. After such engagement, the recesses 51 in the associated panels are filled with concrete so as to finish off the face of the associated panels. It should also be noted that in this embodiment, upon placement of the slabs of polystyrene foam insulative material on the surface of the still wet concrete, spaces are left between the associated blocks of insulative material that are subsequently filled with concrete, the concrete forming the panel being full panel thickness in the spaces between the associated blocks of polystyrene foam insulative material so as to form integral longitudinally extending studs 61 and transversely extending rails 62 as illustrated in FIG. 8. These rails and studs lend rigidity to the structure and of course, for additional rigidity, appropriate reinforcing bars may be embedded in the concrete that fills these spaces.

Thus, as illustrated in FIGS. 12 and 13, the slabs of rigid polystyrene insulative foam material 44 lie embedded in the concrete between the two surface skins and between the two layers of wire mesh so that the volume of concrete that would normally fill the recess formed by the slab of insulative material is displaced, thereby lightening the panel, inasmuch as each of the slabs of polystyrene foam insulative material is extremely light in weight, thus minimizing the overall weight of the panel by an amount equal to the weight of the concrete displaced.

In the illustration of FIGS. 14 and 15, the construction of the panel is shown in different stages. In the interest of clarity, the form structure or mold that contains the partially completed panel prior to hardening of the concrete is omitted. The facing sheet 63 is illustrated as if it has already solidified, and the areas to be covered by each of the blocks 44 of rigid thermal insulative material is outlined in broken lines. One of the blocks of thermal insulative material is shown exploded from the position in which it will ultimately rest on the panel for purposes of clarity. It should be understood that once all of the thermal insulative blocks or slabs 44 are positioned on the initial facing sheet, the form or mold is filled with concrete as previously described.

In the stage of the construction illustrated in FIG. 15, the slabs 44 of rigid insulative material have been positioned on the face sheet of the panel and the second layer 46 of wire mesh has been extended in a superposed relation over the array of insulative slabs in preparation for the application of the final surface layer or facing sheet of the panel.

Figure 19:
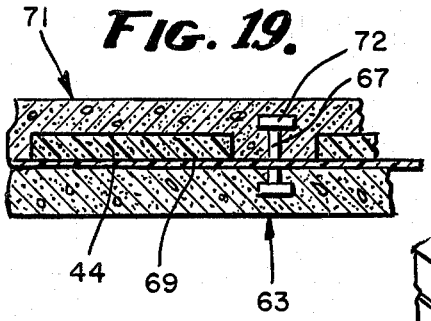
FIG. 19 is a fragmentary cross-sectional view illustrating the manner in which the two facing sheets of the panel are held together by ties.
Figure 18:
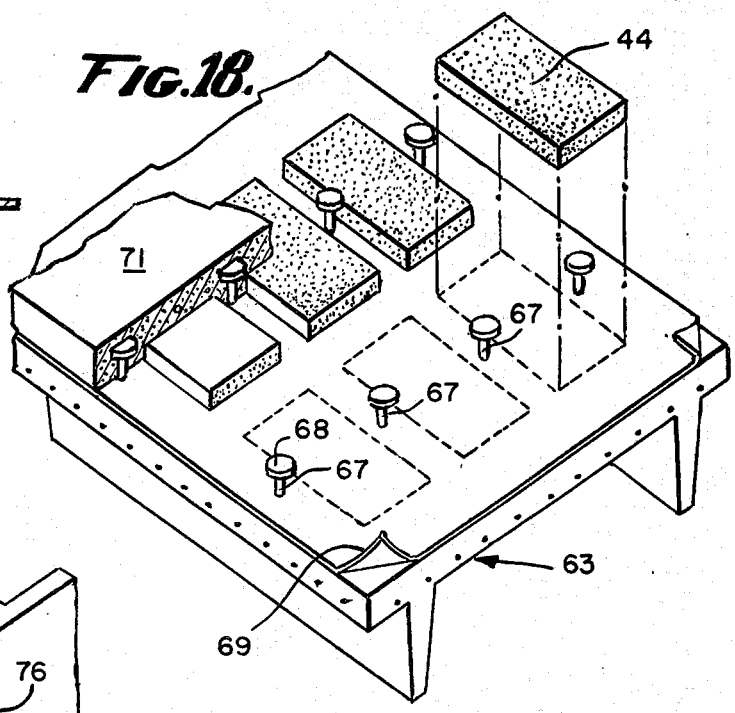
FIG. 18 is a fragmentary perspective view showing the panel of FIG. 17 in one stage of its construction
Figure 17:
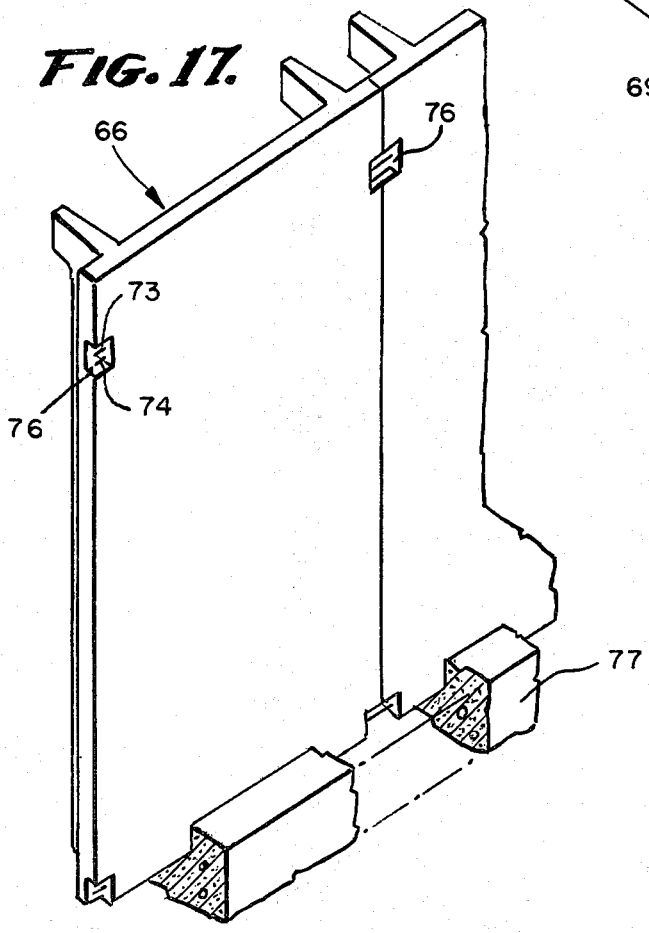
FIG. 17 is a perspective view of still another panel embodiment of the invention.

In the embodiment illustrated in FIGS. 17 through 19, there is depicted a panel designated generally by the numeral 66 constructed in substantially the same manner as the panel illustrated in FIG. 8, with the exception that tie members 67 are provided, each of the ties having a relatively large head 68 embedded in the first face sheet 63 of the panel when it is poured, the ties 67 projecting upwardly and being spaced so that the slabs 44 of rigid insulative material may be dropped between the ties as shown in FIG. 18. Once the facing sheet 63 is poured, and prior to application of the insulative slabs 44 in the manner previously discussed, there is provided a moisture or waterproof membrane 69 which may be insulative as well and which covers the entire surface of the first-poured facing sheet of the panel.

In some instances, it will be necessary to let the first facing sheet set up somewhat before application of the waterproof and insulative membrane 69. In other instances, it may be possible to immediately drape the still wet concrete with the waterproof membrane and then apply suitable waterproofing material at the union between the waterproof membrane and the shank of each of the ties 67. Thereafter, the insulative slabs 44 are placed on top of the waterproof membrane and a second facing sheet 71 of concrete is poured as before so as to fill the spaces between the insulative blocks and provide a second facing sheet having a thickness of course being greater in the spaces between the insulative slabs. It will of course be understood that once the waterproof membrane has been positioned over the first-to-be-poured facing sheet 63, appropriate heads 72 are provided on each of the ties so as to bind the two facing sheets together when the concrete has hardened.

This construction is illustrated in enlarged scale in FIG. 19 which shows the membrane 69 underlying the associated slab 44 of insulative material, and showing the tie 67 extending between the two facing sheets 71 and 63 to tie the two facing sheets together. Once completed, as previously described, transversely extending tie rods 73 and 74 projecting into suitable recesses 76 along each of the longitudinal edges of the panel are utilized to tie two adjacent panels together as illustrated in FIG. 17. As there illustrated, the panels are supported on an appropriate footing 77 which forms the boundary for the outer periphery of a concrete floor to be poured in place.

It should be understood that where welded wire mesh is indicated, herein, it may be appropriately replaced by reinforcing iron bars or a reinforcing matt. Also, while dimensions have been indicated for clarity in the description, obviously other appropriate dimensions may be used. Additionally, while foam type polystyrene insulative material has been specifically mentioned, the invention is not limited to the use of this material and should be understood to include any appropriate insulative material.

Having thus described the invention, what is claimed to be new and novel and desired to be covered by letters patent of the United States is as follows:

1. A massive concrete wall panel having thermal insulating and sound absorbing characteristics, comprising:

a first facing sheet formed of poured, molded concrete, said first sheet being generally rectangular in shape and having upper and lower surfaces defined by transversely extending top and bottom edges and longitudinally extending first and second lateral edges;

first and second spaced longitudinal ribs integrally formed with said lower surface of said first facing sheet, said ribs being located adjacent said first and second lateral edges, respectively, said ribs being formed to provide the vertical load-bearing strength of said wall panel;

truss-form reinforcing bars embedded within each of said first and second ribs;

reinforcing wire matt means embedded in said first facing sheet;

first and second typing recesses formed at said first and second lateral edges;

transversly extending reinforcing ties embedded in said first facing sheet, said ties having first and second ends terminating in said first and second tying recesses, respectively, to provide exposed tie ends for use in securing adjacent panels together;

a plurality of generally rectangular hollow recesses formed in said upper surface of said first facing sheet, said hollow recesses being spaced laterally and longitudinally over a major portion of said upper surface to define therebetween a plurality of longitudinally extending studs and a plurality of transversely extending rails, the side surfaces of said studs and rails being tapered to provide tapering side walls for said hollow receses;

reinforcing bars embedded in said studs and said rails;

a first rectangular block of thermally insulative material secured in each said hollow recess;

a second rectangular block of sound absorbing material secured in each said hollow recess, said first and second blocks being coextensive with said recesses, with one block being superimposed on the other; and cover means engaging said upper surface of said wall panel first facing sheet to retain said first and second blocks.

2. The panel of claim 1, wherein said cover means comprises a rectangular cover plate for each said hollow recess, each said cover plate covering and retaining the thermally insulative and sound absorbing blocks in its corresponding hollow recess, and each said cover plate wedgingly engaging the tapered side walls of its corresponding hollow recess.

3. The panel of claim 1 wherein said cover means comprises a second facing sheet of poured concrete, said second facing sheet having a lower surface engaging and enclosing said sound absorbing and thermally insulative blocks and said studs and rails within said wall panel and having an upper surface which provides a smooth wall surface for said panel.

4. A massive concrete wall panel having thermal insulating and sound absorbing characteristics, comprising:

a first facing sheet formed of poured, molded concrete, said first sheet being generally rectangular in shape and having upper and lower surfaces defined by transversely extending top and bottom edges and longitudinally extening first and second lateral edges;

first and second spaced, longitudinal ribs integrally formed with said lower surface of said first facing sheet, said ribs being located adjacent said first and second lateral edges, respectively, said ribs being formed to provide the vertical load-bearing strength of said wall panel;

truss-form reinforcing bars embedded within each of said first and second ribs;

first reinforcing wire matt means embedding in said first facing sheet;

a plurality of generally rectangular thermally insulative blocks positioned on said upper surface of said first facing sheet, said blocks being spaced and aligned both laterally and longitudinally to define there between a plurality of longitudinally and laterally extending channels;

second reinforcing wire matt means overlying said thermally insulative block;

a second rectangular facing sheet of poured, molded concrete having upper and lower surfaces defined by transversly extending top and bottom edges and longitudinally extending first and second lateral edges, the lower surface of said second facing sheet engaging said thermally insulative blocks and the facing sheet surrounding said blocks, said second facing sheet embedding said second reinforcing wire matt means, the lower surface of said second facing panel extending into said plurality of longitudinally and laterally extending channels to form a plurality of longitudinal studs and lateral rails integrally formed within said wall panel and extending between said thermally insulative blocks, said first and second facing sheets being laterally and longitudinally coextensive and coacting to secure said blocks within said panel and to define a wall panel wherein the lower surface of said first facing sheet and the upper surface of said second facing sheet comprise the exterior surfaces of said panel;

first and second tying recesses formed at said first and second longitudinally edges of said second facing sheet; and transversely extending reinforcing ties embedded in said second facing sheet, said ties having first and second ends terminating in said first and second tying recesses, respectively, to provide exposed tie ends for use in securing adjacent panels together.

5. The panel of claim 4, further including a plurality of tie members extending between said first and second facing sheets, each tie member having a first enlarged head portion embedded in said first facing sheet and a second enlarged head portion embedded in said second facing sheet to tie said sheets together.

6. The panel of claim 5, further including a continuous waterproof membrane interposed between said first and said second faing sheets to provide a wall panel having moisture barrier characteristics.

* * * * *